United States Patent [19]

Schutz et al.

[11] Patent Number: 4,493,159

[45] Date of Patent: Jan. 15, 1985

[54] SHRINK TUNNEL WITH MOVABLE GATE

[75] Inventors: Rudolph W. Schutz, Walnut Creek; Rudolf R. Weis, Antioch, both of Calif.

[73] Assignee: Crown Zellerbach Corporation, San Francisco, Calif.

[21] Appl. No.: 502,405

[22] Filed: Jun. 8, 1983

[51] Int. Cl.[3] ..... F26B 15/18

[52] U.S. Cl. ..... 34/43; 53/557; 49/199; 432/242; 34/242

[58] Field of Search ..... 53/557, 52; 493/10, 493/13, 14; 49/199, 197; 34/242, 43; 432/242

[56] References Cited

U.S. PATENT DOCUMENTS

| | | | |
|---|---|---|---|
| 2,909,718 | 10/1959 | Lawick | 49/25 |
| 3,096,627 | 7/1963 | Morrison | 34/242 |
| 3,619,970 | 11/1971 | Zelnick | 53/557 |
| 4,417,418 | 11/1983 | Warning | 49/199 |

*Primary Examiner*—Larry I. Schwartz

*Attorney, Agent, or Firm*—Thomas R. Lampe

[57] ABSTRACT

A shrink tunnel, a gate for opening and closing the egress opening of the shrink tunnel, prime mover means for moving the gate, and sensing means operatively connected to the prime mover means to open the gate just prior to exit of an article from the shrink tunnel and to close the gate after the product has exited therefrom.

6 Claims, 3 Drawing Figures

SHRINK TUNNEL WITH MOVABLE GATE

BACKGROUND OF THE INVENTION

A type of equipment commonly used in the packaging industry is the shrink tunnel which is employed to heat plastic wrap previously disposed about a product. This operation results not only in sealing the wrapped material but shrinking it to conform to the general configuration of the enclosed goods.

It will be appreciated that the plastic material after being heated remains tacky and soft for a period of time until it is cooled. This presents operational difficulties when the wrapped product exits from the shrink tunnel since the hot film engages flaps or other flexible elements customarily used to maintain a degree of separation between the heated interior of the shrink tunnel and ambient atmosphere. This contact can result in abrasion of the heated film or even formation of undesired openings therein.

SUMMARY OF THE INVENTION

The aforesaid difficulties are overcome by the present invention which includes a shrink tunnel with a movable gate disposed at the egress opening thereof. Just prior to wrapped articles exiting from the shrink tunnel a mechanism raises the gate to a location where it cannot engage the product or its wrap. Immediately after passage of the product from the shrink tunnel the gate is returned to closed position so that there will not be an undue loss of heat from the tunnel interior.

DESCRIPTION OF THE DRAWINGS

Other characteristics of the invention will be apparent from the following more detailed description and accompanying drawings in which.

DETAILED DESCRIPTION

Figure 1:
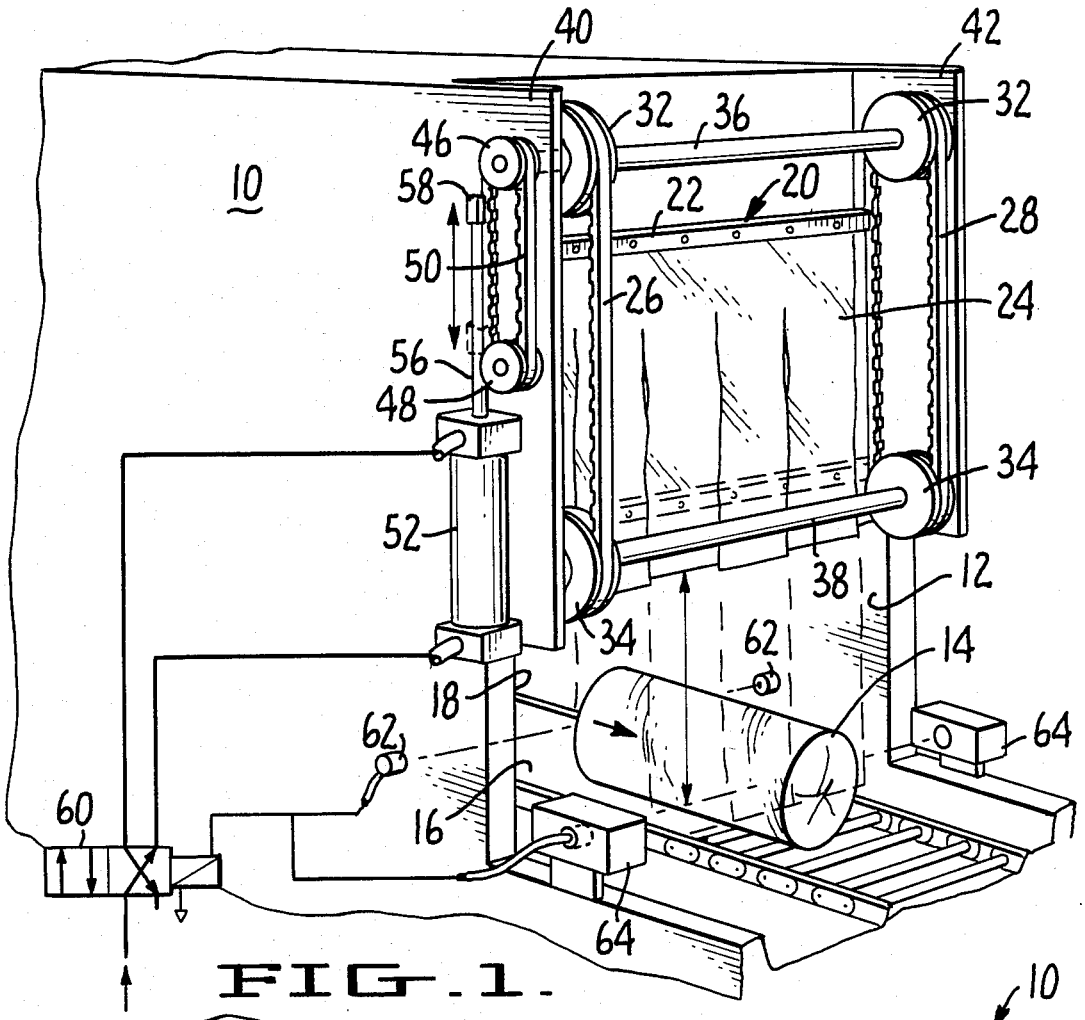
FIG. 1 is an perspective view of a preferred form of apparatus constructed in accordance with the teachings of the present invention with some components thereof illustrated schematically.
Figure 2:
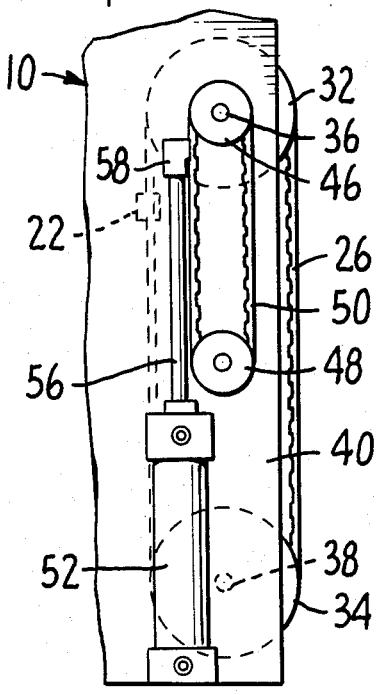
FIG. 2 is an enlarged side view showing selected portions of the apparatus of FIG. 1.
Figure 3:
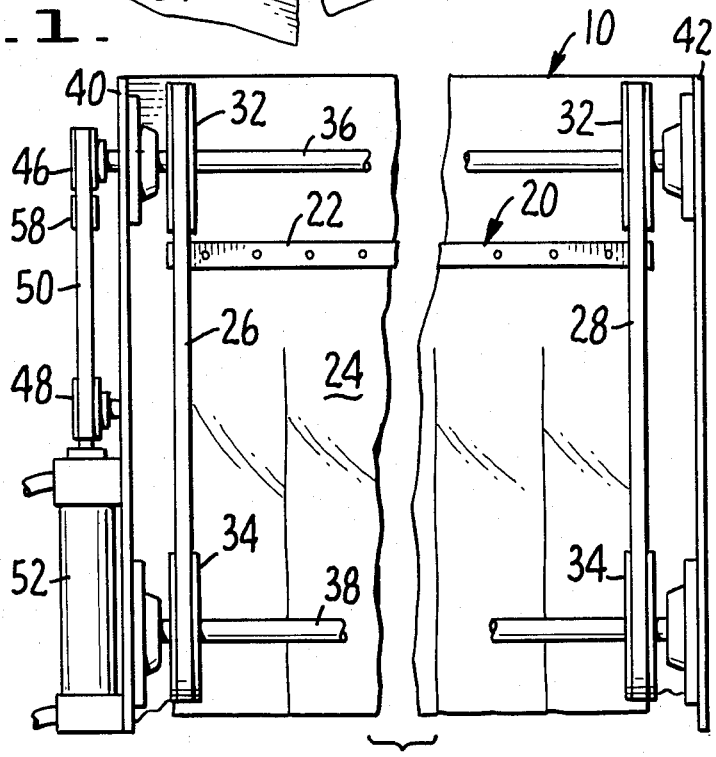
FIG. 3 is an enlarged elevational view of the shrink tunnel gate and its associated mechanism.

Referring to the drawings, a shrink tunnel 10 is disclosed defining an interior 12 for temporarily accommodating an article to be shrink wrapped while the article is conveyed through the tunnel. In the present disclosure, such product 14 is a paper roll to which an outer wrap of plastic shrink film has been applied, said film when heated in the tunnel interior sealing and shrinking itself to conform to the contours of roll 14. A belt conveyor 16 conveys the roll through the tunnel and out an egress opening 18 defined by the tunnel.

To prevent heat loss from the tunnel interior, opening 18 is normally closed by a gate 20 comprising a rigid support component 22 and a flexible component 24 secured to and depending from the support component. Component 24 is preferably constructed of any suitable flexible generally air impermeable heat resistant fabric or other suitable flexible material. The lower portion of the flexible component 24 may, as illustrated, be cut into individual flap segments.

Support component 22 extends between and is secured to endless belts 26 and 28, said belts being disposed about pairs of sheaves 32 and 34. Sheaves 32, 34 are affixed to an upper shaft 36 and a lower shaft 38 journaled at their ends in side plates 40, 42 comprising extensions of the shrink tunnel side walls.

A drive pulley 46 of significantly smaller diameter than sheaves 32, 34 is attached to the one end of upper shaft 36. An idler pulley 48 is disposed below drive pulley 46 and freely rotatably mounted on side plate 40. A drive belt 50 extends between pulleys 46 and 48. A pneumatic cylinder 52 is attached to side plate 40 below idler pulley 48 and slightly offset with respect thereto. A selectively movable piston element 56 extends upwardly from cylinder 52 and is attached at the outermost end thereof through any suitable expedient such as clamp 58 to drive belt 50. Thus, upward movement of piston element 56 will cause clockwise rotation (as viewed in FIG. 1) of drive belt 50 and endless belts 26 and 28. Because of differences in diameter between drive pulley 56 and sheaves 32, 34, belts 26, 28 will move a distance greater in magnitude than the distance moved by drive belt 50. Clockwise movement of belts 26, 28 will cause gate 20 to move from a first, lower position whereat the gate substantially closes opening 18 to a second, raised position whereat the opening is exposed and provides communication between the tunnel interior and the ambient atmosphere. When the gate is in its raised position the lower end thereof is spaced a distance from the top of roll 14 so that it cannot engage the shrink wrap and abrade or otherwise cause harm to it.

Passage of pressurized air to cylinder 52 is controlled by a valve device 60 which alternatively pressurizes and vents opposed ends of the cylinder in a well known manner to cause reciprocating motion of the piston element 56. Operation of valve device 60 is controlled by any suitable valve control and sensing mechanism which includes a first pair of photoelectric elements 62 inside the tunnel interior. Elements 62 sense the lead end of roll 14 as it is conveyed toward the egress opening 18 and actuate the valve device 60 to pressurize the lower end of cylinder 52 and thus move the gate to its raised position. A second pair of photoelectric elements 64 are disposed just outside the shrink tunnel interior. Elements 64 sense the passage of the tail end of product 14 and reorient the valve device 60 to pressurize the upper end of cylinder 52 to return gate 20 to its lower position.

We claim:

1. In combination:

a shrink tunnel defining an interior for temporarily accomodating an article to be shrink wrapped while said article is conveyed through said tunnel and additionally defining an egress opening through which said article exits from said interior after being shrink wrapped;

a gate moveable between a first position whereat said gate substantially closes said opening and a second position whereat said opening is open and provides communication between the tunnel interior and the ambient atmosphere;

prime mover means operatively connected to said gate for moving said gate between said first and second positions;

sensing means operatively connected to said prime mover means for sensing the location of said article, said prime mover means moving the gate from the first position to the second position when the conveyed article is approaching said egress opening and returning the gate to said first position after said article has exited from said egress opening; and gate transport means mounted on said shrink tunnel and supporting said gate, said gate transport means operatively connected to said prime mover means and including a pair of spaced rotatable shafts, a pair of sheaves mounted on each of said shafts at spaced locations thereon whereby the sheaves mounted on one shaft are in general alignment with the sheaves mounted on the other of said shafts, and endless belts extending between said spaced shafts and disposed about the generally aligned sheaves thereof, said gate being affixed to said belts and movable therewith upon rotation of said shafts and sheaves by said prime mover means.

2. The apparatus of claim 1 wherein said gate transport means additionally comprises a drive pulley mounted on one of said shafts and a drive belt disposed about said drive pulley and attached to said prime mover means, whereby actuation of said prime mover means and consequent movement of said drive belt will effect movement of said gate by said gate transport means.

3. The apparatus of claim 2 wherein said drive pulley has a smaller diameter than the sheaves mounted on the shaft to which the drive pulley is attached whereby an incremental movement of said drive belt will cause a correspondingly greater movement of said endless belts and said gate.

4. The apparatus of claim 1 wherein said prime mover means comprises an air cylinder.

5. The apparatus of claim 1 wherein said sensing means includes two photoelectric devices, one of said devices being positioned in said tunnel interior and the other of said devices being positioned adjacent said egress opening outside said tunnel interior.

6. In combination:

a shrink tunnel defining an interior for temporarily accomodating an article to be shrink wrapped while said article is conveyed through said tunnel and additionally defining an egress opening through which said article exits from said interior after being shrink wrapped;

a gate moveable between a first position whereat said gate substantially closes said opening and a second position whereat said opening is open and provides communication between the tunnel interior and the ambient atmosphere;

prime mover means operatively connected to said gate for moving said gate between said first and second positions;

sensing means operatively connected to said prime mover means for sensing the location of said article, said prime mover means moving the gate from the first position to the second position when the conveyed article is approaching said egress opening and returning the gate to said first position after said article has exited from said egress opening; and gate transport means mounted on said shrink tunnel and supporting said gate, said gate transport means operatively connected to said prime mover means and including a pair of spaced rotatable shafts, sheaves mounted on said shafts, and endless belts extending between said spaced shafts and disposed about the sheaves thereof, said gate being affixed to said endless belts and movable therewith upon rotation of said shafts and sheaves by said prime mover means and comprising a rigid support component extending between said endless belts and a flexible component secured to and depending from said support component.

* * * * *